US012774833B2

(12) United States Patent
Hu

(10) Patent No.: US 12,774,833 B2
(45) Date of Patent: Oct. 27, 2026

(54) EJECTOR

(71) Applicant: Carrier Corporation, Palm Beach Gardens, FL (US)

(72) Inventor: Guohong Hu, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 126 days.

(21) Appl. No.: 18/971,227

(22) Filed: Dec. 6, 2024

(65) Prior Publication Data

US 2025/0198674 A1 Jun. 19, 2025

(30) Foreign Application Priority Data

Dec. 18, 2023 (CN) ..... 202311743476.X

(51) Int. Cl.
*F25B 41/00* (2021.01)

(52) U.S. Cl.
CPC ..... *F25B 41/00* (2013.01); *F25B 2341/0012* (2013.01)

(58) Field of Classification Search
CPC ..... F25B 41/00; F25B 2341/0012; F25B 2341/0013; F25B 9/08; F04F 5/10; F04F 5/24; F04F 5/463; F04F 5/461; F04F 5/04; F04F 5/44; F04F 5/48
See application file for complete search history.

(56) References Cited

U.S. PATENT DOCUMENTS

| | | | | |
|---|---|---|---|---|
| 4,702,090 | A * | 10/1987 | Barclay | F25B 21/00 62/3.6 |
| 2004/0172966 | A1* | 9/2004 | Ozaki | F25B 9/008 62/500 |
| 2005/0188719 | A1 | 9/2005 | Sugiura et al. | |
| 2005/0204771 | A1* | 9/2005 | Ogata | F25B 41/00 62/500 |
| 2017/0108256 | A1 | 4/2017 | Verma et al. | |
| 2018/0120004 | A1* | 5/2018 | Lee | F25B 41/00 |

FOREIGN PATENT DOCUMENTS

| | | |
|---|---|---|
| CN | 1207524 C | 6/2005 |
| CN | 1247943 C | 3/2006 |
| CN | 1311206 C | 4/2007 |

(Continued)

OTHER PUBLICATIONS

Extended European Search Report received for EP Application No. 24221267.8, mailed on Feb. 20, 2025, 8 Pages.

*Primary Examiner* — Emmanuel E Duke
(74) *Attorney, Agent, or Firm* — Souad Hakim

(57) ABSTRACT

Described herein is an ejector and a refrigeration system. The ejector includes: a housing; a nozzle; a first retainer fixed in the nozzle; a needle valve that is provided in the nozzle and includes a first end, a second end, and a threaded section. The threaded section is engaged with the first retainer, and the first end being movable to adjust an opening degree of the nozzle outlet; and a first magnetic rotation mechanism including a first outer ring and a first inner ring. An inner surface of the first outer ring and an outer surface of the first inner ring is spaced from and opposed to each other and correspondingly provided with a plurality of groups of magnets having opposite magnetic properties respectively.

19 Claims, 13 Drawing Sheets

(56) References Cited

FOREIGN PATENT DOCUMENTS

| | | | | | |
|---|---|---|---|---|---|
| CN | 1321302 | C | | 6/2007 | |
| CN | 1470821 | B | | 5/2010 | |
| CN | 106938224 | A | | 7/2017 | |
| CN | 107115986 | A | | 9/2017 | |
| CN | 110226044 | A | | 9/2019 | |
| CN | 107490207 | B | | 11/2019 | |
| CN | 211574369 | U | | 9/2020 | |
| CN | 108603700 | B | | 5/2021 | |
| EP | 0889244 | A2 | | 1/1999 | |
| EP | 2646763 | B1 | | 8/2016 | |
| EP | 3315879 | A1 | | 5/2018 | |
| JP | 2005069599 | A | * | 3/2005 | ..... F25B 41/00 |
| JP | 2005282507 | A | | 10/2005 | |
| JP | 2008139003 | A | * | 6/2008 | ..... F25B 41/00 |

* cited by examiner

EJECTOR

CROSS REFERENCE TO A RELATED APPLICATION

The application claims the benefit of China Patent Application No. 202311743476.X filed Dec. 18, 2023, the contents of which are hereby incorporated in their entirety.

TECHNICAL FIELD

The present disclosure relates to a field of refrigeration equipment, and in particular, to an ejector and a refrigeration system using the ejector.

BACKGROUND ART

An ejector (also called an ejection device) is a component that increases a pressure of an ejected fluid without consuming electrical or mechanical energy. Since the ejector has a small volume, a light weight, a compact structure, and high efficiency, it has gradually become an indispensable component in a refrigeration or heating system.

A nozzle is a main component of the ejector, and a flow rate of a refrigerant ejected by the nozzle is very important for an effect of the refrigeration or heating system. When system operating conditions are changed, the flow rate of the refrigerant at a nozzle outlet can be changed by changing a cross-sectional area of the nozzle outlet, thereby adapting to needs of the changing operating conditions. However, this requires an addition of an electric drive mechanism, resulting in an increase in the volume of the ejector.

SUMMARY OF THE INVENTION

In view of the above problems, the present disclosure provides an ejector and a refrigeration system for solving or alleviating some problems existing in the related art.

A first aspect of the present disclosure provides an ejector. The ejector includes:

a housing including a first suction port and a discharge port, the discharge port being located at one end of the housing in an axial direction;

a nozzle that is provided in the housing and includes a hollow body and a nozzle outlet, an interior of the hollow body being in communication with the first suction port, and the nozzle outlet being in communication with the discharge port;

a first retainer fixed in the nozzle, a center of which being formed with a first retainer through hole;

a needle valve including a first end, a second end, and a threaded section between the first end and the second end, the threaded section being engaged with the first retainer through hole, and the first end being movable between a position away from the nozzle outlet and a position abutting against the nozzle outlet to adjust an opening degree of the nozzle outlet; and a first magnetic rotation mechanism including a first outer ring and a first inner ring coaxially disposed on an inner side of the first outer ring, an inner surface of the first outer ring and an outer surface of the first inner ring being spaced from and opposed to each other and correspondingly provided with a plurality of groups of magnets having opposite magnetic properties respectively, a center of the first inner ring being provided with an inner ring through hole, and the second end of the needle valve being matched with and passing through the inner ring through hole in a manner that allows sliding in the axial direction and torque transmission.

In an optional technical solution, the ejector further includes: an adapter detachably connected to an end of the housing opposite to the discharge port, the adapter including a first cylindrical extension, the first outer ring being sleeved outside the first cylindrical extension, and the first inner ring being sleeved inside the first cylindrical extension; and an end cap detachably fixed to the first cylindrical extension.

In an optional technical solution, a connection between the first cylindrical extension and the end cap is filled with a sealant.

In an optional technical solution, a cross section of the second end of the needle valve is non-circular.

In an optional technical solution, a transition section is provided between the second end of the needle valve and the threaded section, and a cross-sectional dimension of the transition section is larger than that of the threaded section and the second end.

In an optional technical solution, the ejector further includes: a second retainer fixed in the nozzle and located on a side of the first retainer close to the nozzle outlet, in which a center of the second retainer is provided with a second retainer through hole through which the needle valve passes.

In an optional technical solution, an outer periphery of the hollow body includes a first abutment portion and a second abutment portion both abutting against an inner wall of the housing, the first abutment portion is located on a side of the second abutment portion close to the discharge port, a portion of the hollow body between the first abutment portion and the second abutment portion is a first chamber, the first chamber is in communication with the first suction port, and an outer periphery of the first chamber is provided with a hollow portion.

In an optional technical solution, in a direction close to the discharge port along the axial direction, the nozzle outlet is formed as a nozzle outer wall converging section having a reduced diameter, the inner wall of the housing is provided with a housing inner wall converging section matched with the nozzle outer wall converging section, and the housing further includes a second suction port, and a second chamber that is in communication with the second suction port is formed between the first abutment portion and the housing inner wall converging section.

In an optional technical solution, a narrower diameter end of the housing inner wall converging section is a refrigerant mixture inlet, and the inner wall of the housing further includes an equal-diameter section and a diverging section, and the equal-diameter section and the diverging section, which are sequentially provided along a flow direction of a refrigerant mixture, allow the refrigerant mixture inlet and the discharge port to communicate with each other, and the nozzle is movable in the axial direction to adjust an opening degree of the refrigerant mixture inlet.

In an optional technical solution, the ejector further includes: a second magnetic rotation mechanism including a second outer ring and a second inner ring coaxially disposed on an inner side of the second outer ring, in which an inner surface of the second outer ring and an outer surface of the second inner ring are spaced from and opposed to each other and correspondingly provided with a plurality of groups of magnets having opposite magnetic properties respectively, and the inner surface of the second inner ring is in threaded connection with an outer surface of the nozzle.

In an optional technical solution, an end of the housing opposite to the discharge port is provided with a second cylindrical extension, the second outer ring is sleeved outside the second cylindrical extension, and the second inner ring is sleeved inside the second cylindrical extension, and the adapter is in threaded connection with the second cylindrical extension, and the threaded connection is filled with a sealant.

In an optional technical solution, the ejector further includes: a guide mechanism provided between the housing and the nozzle and configured to limit circumferential rotation of the nozzle relative to the housing.

In an optional technical solution, the guide mechanism further includes:

- a recess provided on an outer sidewall of the nozzle,
- a sliding groove provided on the inner wall of the housing and extending in the axial direction, and
- a ball, one part of which being accommodated in the recess, and the other part of which being accommodated in the sliding groove.

In an optional technical solution, the inner surface of the first outer ring is provided with a first magnet and a second magnet, the first magnet and the second magnet are sequentially and alternately connected, magnetism of the first magnet is opposite to magnetism of the second magnet, and the number of the first magnet and the number of the second magnet are the same and are respectively at least two, and the outer surface of the first inner ring is provided with a third magnet and a fourth magnet, the third magnet and the fourth magnet are sequentially and alternately connected, magnetism of the third magnet is opposite to magnetism of the fourth magnet, and the number of the third magnet and the number of the fourth magnet are the same and are respectively at least two.

In an optional technical solution, the first magnet and the second magnet are fixed on the inner surface of the first outer ring by bonding, riveting, or threaded connection, and the third magnet and the fourth magnet are fixed on the outer surface of the first inner ring by bonding, riveting, or threaded connection.

In an optional technical solution, the first magnet and the second magnet are the same in size and shape, and the third magnet and the fourth magnet are the same in size and shape.

In an optional technical solution, two sides of the first outer ring are respectively provided with a first retaining ring, and the first retaining ring includes

- a first annular body provided between the first outer ring and the housing, and
- a plurality of first balls rotatably provided in the first annular body, and
- two sides of the first inner ring are respectively provided with a second retaining ring, and the second retaining ring includes
- a second annular body provided between the first inner ring and the housing, and
- a plurality of second balls rotatably provided in the second annular body.

In an optional technical solution, an outer surface of the first outer ring is provided with a gear, and the first outer ring is in transmission connection with an external motor through the gear.

Another aspect of the present disclosure provides a refrigeration system. The refrigeration system is provided with the foregoing ejector.

DESCRIPTIONS OF THE DRAWINGS

LIST OF REFERENCE NUMERALS

Figure 1:
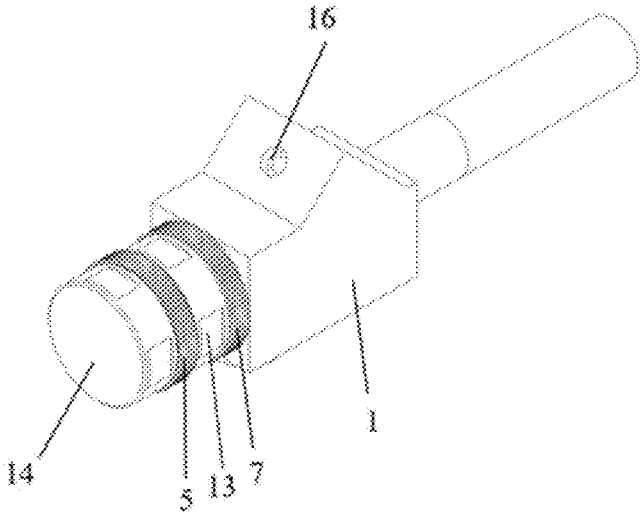
FIG. 1 is a schematic view of an appearance structure of an ejector according to the present disclosure.

Housing 1, first suction port 11, discharge port 12, adapter 13, first cylindrical extension 131, end cap 14, housing inner wall converging section 15, refrigerant mixture inlet 151, second suction port 16, equal-diameter section 17, diverging section 18, and second chamber 19;

Nozzle 2, hollow body 21, first abutment portion 211, second abutment portion 212, first chamber 213, hollow portion 214, nozzle outer wall converging section 215, and nozzle outlet 22;

First retainer 3, first retainer through hole 31, and first pin 32;

Needle valve 4, first end 41, second end 42, threaded section 43, and transition section 44;

First magnetic rotation mechanism 5, first outer ring 51, first magnet 511, second magnet 512, first gear 513, first annular groove 514, first inner ring 52, inner ring through hole 521, third magnet 522, fourth magnet 523, second annular groove 524, and first external motor 53;

Second retainer 6, second retainer through hole 61, and second pin 62;

Second magnetic rotation mechanism 7, second outer ring 71, second gear 711, second inner ring 72, second cylindrical extension 73, and second external motor 74;

Guide mechanism 8, recess 81, sliding groove 82, and ball 83; First retaining ring 91, first annular body 911, first ball 912, first ball ring groove 9121, second retaining ring 92, second annular body 921, second ball 922, second ball ring groove 9221, third retaining ring 93, third ball 931, third ball ring groove 932, fourth retaining ring 94, fourth ball 941, and fourth ball ring groove 942.

DETAILED DESCRIPTION

The technical solution in the embodiments of the present disclosure will be clearly and completely described below with reference to the accompanying drawings in the embodiments of the present disclosure, and obviously, the described embodiments are merely a part of embodiments of the present disclosure, and are not all embodiments. Based on the embodiments in the present disclosure, all other embodiments obtained by those skilled in the art without creative work fall within the protection scope of the present disclosure.

It is known to those skilled in the art that an ejector uses the Venturi effect to increase a pressure energy of a fluid at a suction port of the ejector by a motive fluid supplied to a motive port of the ejector. Thus, the ejector can be arranged in a refrigeration system to cause the refrigerant to do work. For example, the ejector is configured to eject a low-pressure refrigerant from an evaporator using a high-pressure refrigerant from a condenser and mix them into a medium-pressure gas-liquid two-phase refrigerant.

Figure 5:
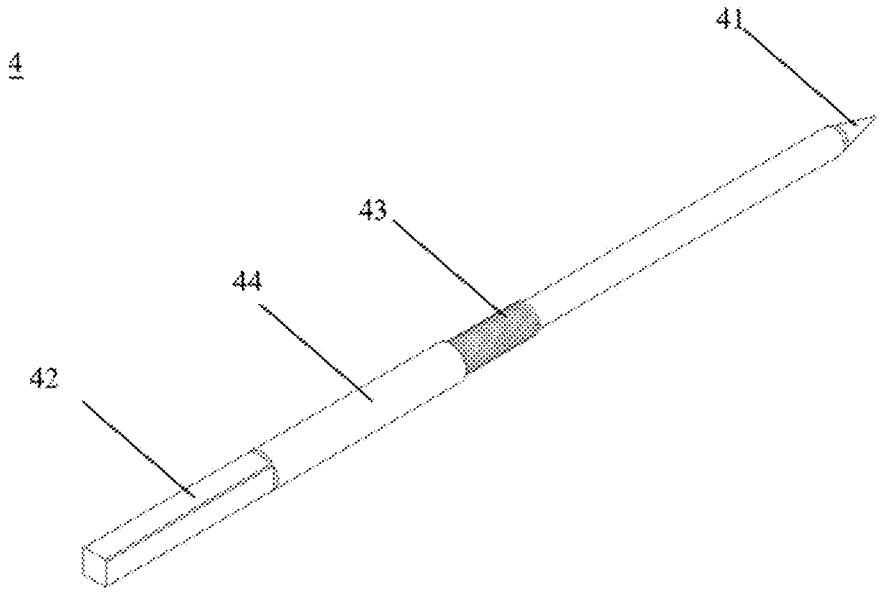
FIG. 5 is a perspective view of a needle valve according to the present disclosure.
Figure 6:
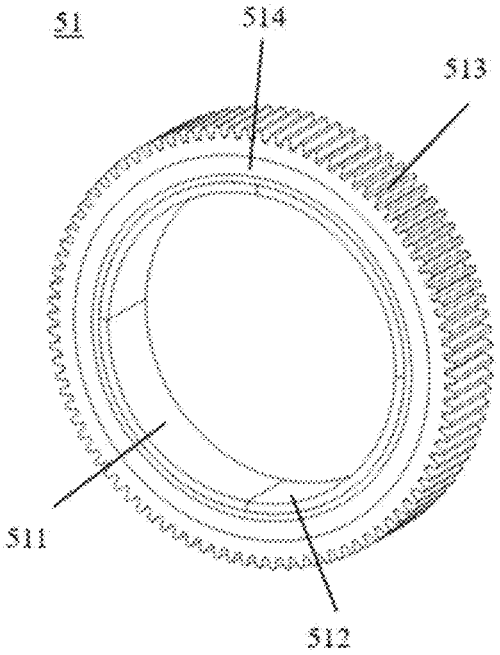
FIG. 6 is a perspective view of a first outer ring according to the present disclosure.
Figure 7:
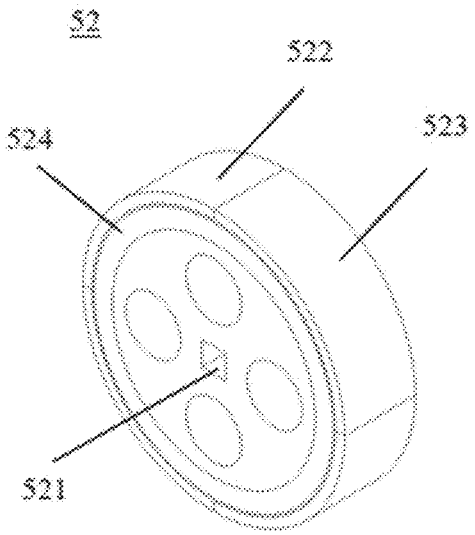
FIG. 7 is a perspective view of a first inner ring according to the present disclosure.
Figure 8:
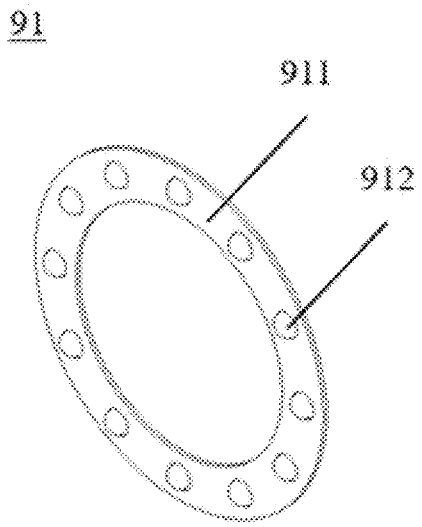
FIG. 8 is a perspective view of a first retaining ring according to the present disclosure.

As illustrated in FIGS. 1, 2, 3, and 4, an embodiment of the present disclosure provides an ejector. The ejector includes a housing 1, a nozzle 2, a first retainer 3, a needle valve 4, and a first magnetic rotation mechanism 5. Specifically, the housing 1 includes a first suction port 11 and a discharge port 12, and the discharge port 12 is located at one end of the housing 1 in an axial direction. The nozzle 2 is provided in the housing 1, and the nozzle 2 includes a hollow body 21 and a nozzle outlet 22, an interior of the hollow body 21 is in communication with the first suction port 11, and the nozzle outlet 22 is in communication with the discharge port 12. The first retainer 3 is fixed in the nozzle 2, and a center of the first retainer 3 is formed with a first retainer through hole 31. In the present embodiment, the first retainer through hole 31 is described by taking a threaded hole as an example. The needle valve 4 is provided in the nozzle 2, and as illustrated in FIG. 5, the needle valve 4 includes a first end 41, a second end 42, and a threaded section 43 located between the first end 41 and the second end 42, the threaded section 43 is engaged with the first retainer through hole 31, and the first end 41 is movable between a position away from the nozzle outlet 22 and a position abutting against the nozzle outlet 22 to adjust an opening degree of the nozzle outlet 22. As illustrated in FIGS. 6, 7, and 8, the first magnetic rotation mechanism 5 includes a first outer ring 51 and a first inner ring 52 coaxially disposed on an inner side of the first outer ring 51, an inner surface of the first outer ring 51 and an outer surface of the first inner ring 52 are spaced from and opposite to each other, and correspondingly provided with a plurality of groups of magnets having opposite magnetic properties respectively (a first magnet 511, a second magnet 512, a third magnet 522, and a fourth magnet 523), a center of the first inner ring 52 is provided with an inner ring through hole 521, and the second end of the needle valve 4 is matched with and passes through the inner ring through hole 521 in a manner that allows sliding in the axial direction and torque transmission.

When the first outer ring 51 of the first magnetic rotation mechanism 5 according to the present disclosure and the magnets on the first outer ring 51 rotate, the magnets on the first inner ring 52 rotate under the action of magnetic force to drive the first inner ring 52 and the second end 42 of the needle valve 4 connected with the first inner ring 52 to rotate, and under the action of this rotation and the cooperation between the threaded section 43 and the threaded hole, the first end 41 of the needle valve 4 moves between a position away from the nozzle outlet 22 and a position abutting against the nozzle outlet 22 to adjust an opening degree of the nozzle outlet 22, thereby adjusting of a refrigerant flow rate at an outlet of the ejector. The first magnetic rotation mechanism 5 according to the present disclosure is provided in a circumferential direction of the housing 1, which reduces a volume of the housing 1 in the axial direction, and achieves rotation and movement of the needle valve 4 inside the housing 1 through non-contact transmission torque of the magnets on the first outer ring 51 and the first inner ring 52, which simplifies a drive structure of the needle valve 4 and reduces a processing difficulty of the ejector.

A specific structure of the first magnetic rotation mechanism 5 will be described in detail below with reference to FIGS. 6 to 8.

The inner surface of the first outer ring 51 is provided with a first magnet 511 and a second magnet 512, the first magnet 511 and the second magnet 512 are sequentially and alternately connected, magnetism of the first magnet 511 is opposite to magnetism of the second magnet 512, and the number of the first magnet 511 and the number of the second magnet 512 are the same and are respectively at least two, and the outer surface of the first inner ring 52 is provided with a third magnet 522 and a fourth magnet 523, the third magnet 522 and the fourth magnet 523 are sequentially and alternately connected, magnetism of the third magnet 522 is opposite to magnetism of the fourth magnet 523, and the number of the third magnet 522 and the number of the fourth magnet 523 are the same and are respectively at least two. It is easy for those skilled in the art to understand that the number of the first magnet 511, the second magnet 512, the third magnet 523, and the fourth magnet 524 is not limited to two, and may be three, four, five or more, that is, six pairs of magnets, eight pairs of magnets, ten pairs of magnets or more may be used between the first inner ring 52 and the first outer ring 51.

In one embodiment of the present disclosure, the first magnet 511 and the second magnet 512 are fixed on the inner surface of the first outer ring 51 by bonding, riveting, or threaded connection, and the third magnet 522 and the fourth magnet 523 are fixed on the outer surface of the first inner ring 52 by bonding, riveting, or threaded connection. Further, the first magnet 511 and the second magnet 512 may be designed to be the same in size and shape, and the third magnet 522 and the fourth magnet 523 may also be designed to be the same in size and shape, thereby reducing production costs.

Figure 4:
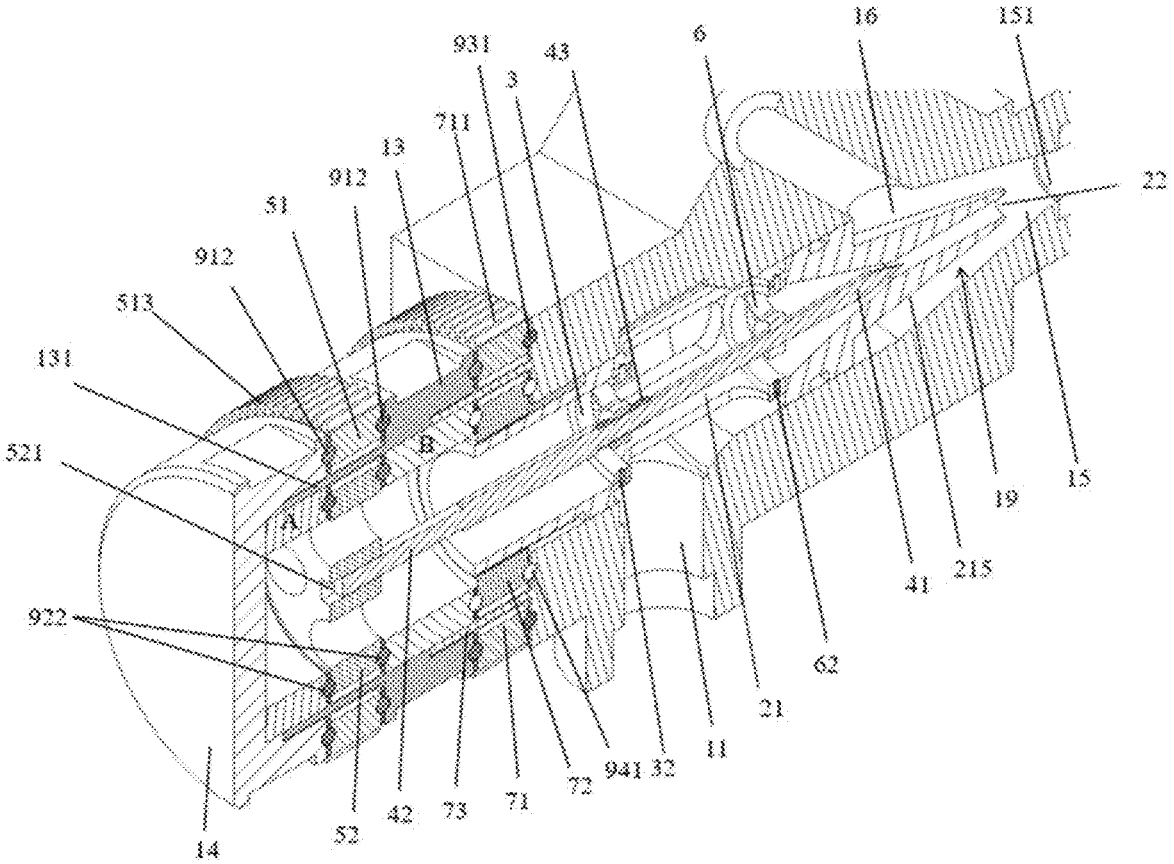
FIG. 4 is a partially enlarged schematic view of the ejector in FIG. 3 according to the present disclosure.
Figure 9:
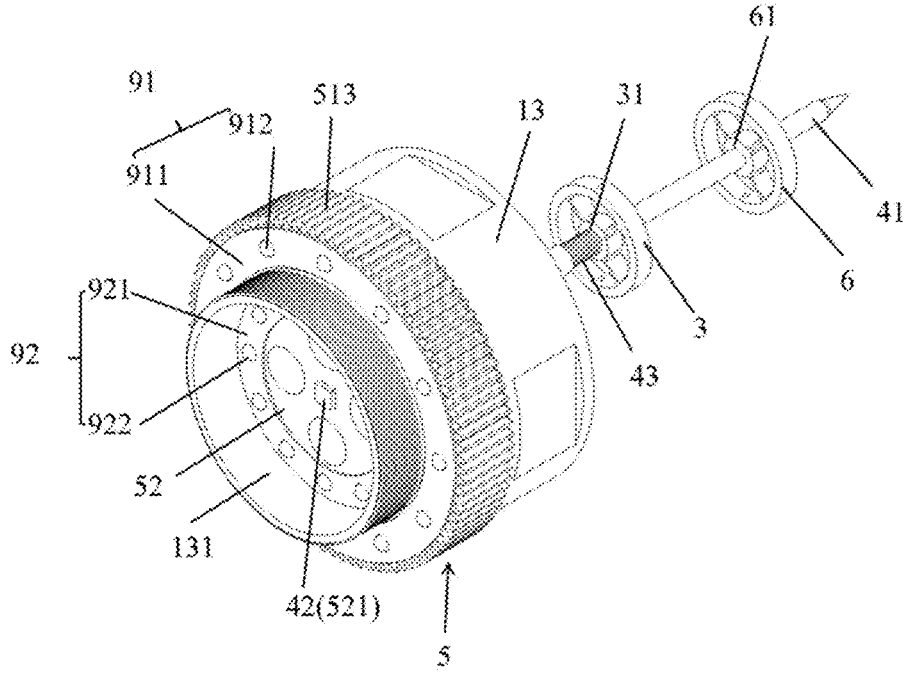
FIG. 9 is a schematic diagram of an assembly of an adapter, a first magnetic rotation mechanism, the needle valve, a first retainer, and a second retainer according to the present disclosure.
Figure 10:
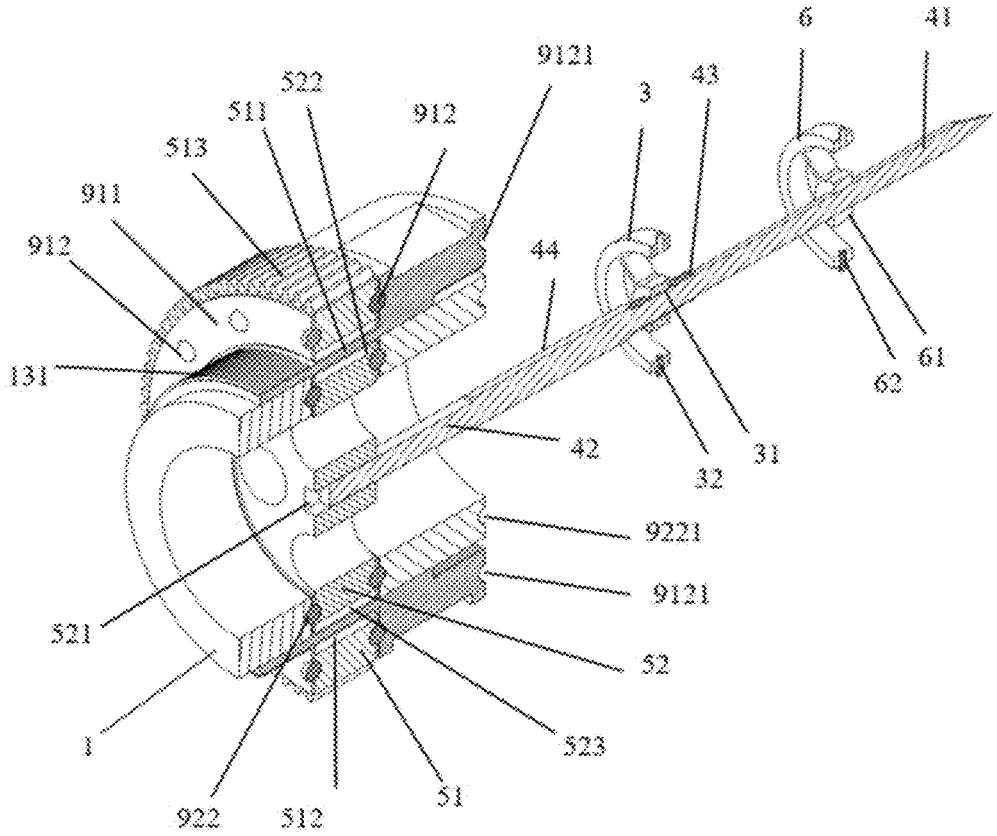
FIG. 10 is a cross-sectional view of FIG. 9 according to the present disclosure.

In one embodiment of the present disclosure, as illustrated in FIGS. 4, 9, and 10, the ejector further includes an adapter 13 and an end cap 14. The adapter 13 is detachably connected to an end of the housing 1 opposite to the discharge port 12, the adapter 13 includes a first cylindrical extension 131, the first outer ring 51 is sleeved outside the first cylindrical extension 131, and the first inner ring 52 is sleeved inside the first cylindrical extension 131. The end cap 14 is detachably fixed to the first cylindrical extension 131. In this way, providing the adapter 13 and the end cap 14 improves mounting flexibility of the ejector and the first magnetic rotation mechanism 5, and can facilitate maintenance and replacement. For example, the end cap 14 is threadably connected to the first cylindrical extension 131. In one embodiment of the present disclosure, a connection between the first cylindrical extension 131 and the end cap 14 is filled with a sealant. The sealant is provided to prevent a high-pressure fluid or a low-pressure fluid in the ejector from leaking from the connection between the first cylindrical extension 131 and the end cap 14.

In one embodiment of the present disclosure, a cross section of the second end 42 of the needle valve 4 is non-circular.

For example, the cross section of the second end 42 of the needle valve 4 is a rectangle, a square, a triangle, a parallelogram, or the like. By making the cross section of the second end 42 of the needle valve 4 non-circular, there is no slippage between the second end 42 and the inner ring through hole 521, so that the second end 42 of the needle valve 4 can be better driven to rotate under the action of rotation of the first inner ring 52, thereby driving the needle valve 4 to move in the axial direction.

In one embodiment of the present disclosure, a transition section 44 is provided between the second end 42 of the needle valve 4 and the threaded section 43, and a cross-sectional dimension of the transition section 44 is greater than that of the threaded section 43 and the second end 42. With the above dimension definition, a movement distance of the needle valve 4 in the axial direction can be defined as a predetermined length. When the needle valve 4 moves in a direction away from the nozzle outlet 22, a dimension of the transition section 44 is larger than a dimension of the inner ring through hole 521, so that a part of the transition section 44 cannot enter the inner ring through hole 521, that is, further movement of the needle valve 4 in the direction away from the nozzle outlet 22 is limited. When the needle valve 4 moves toward the nozzle outlet 22, the dimension of the transition section 44 is larger than a dimension of the threaded section 43, so that the threaded section 43 is blocked by the transition section 44 after rotating a specified pitch, and cannot further move toward the nozzle outlet 22.

The "cross-sectional dimension" referred to here may be a cross-sectional area, a cross-sectional perimeter, or a side length. As long as a part of the transition section 44 cannot pass through the threaded hole or the inner ring through hole 521, it is considered that the cross-sectional dimension of the transition section 44 is greater than that of the threaded section 43 and the second end 42.

In one embodiment of the present disclosure, as illustrated in FIGS. 4, 9, and 10, the ejector further includes a second retainer 6 fixed in the nozzle 2 and located on a side of the first retainer 3 close to the nozzle outlet 22. A center of the second retainer 6 is provided with a second retainer through hole 61 through which the needle valve 4 passes. Providing the second retainer 6 can provide support for movement of the needle valve 4 in the axial direction, ensure stability of the needle valve 4 during the movement in the axial direction, and prevent radial deviation of the needle valve 4 during the movement in the axial direction. Further, in order to improve the stability of the second retainer 6, a pin 62 is further included, which correspondingly connects the second retainer 6 and the hollow body 21 of the nozzle 2, to fix the second retainer 6 to the hollow body 21.

Figure 11:
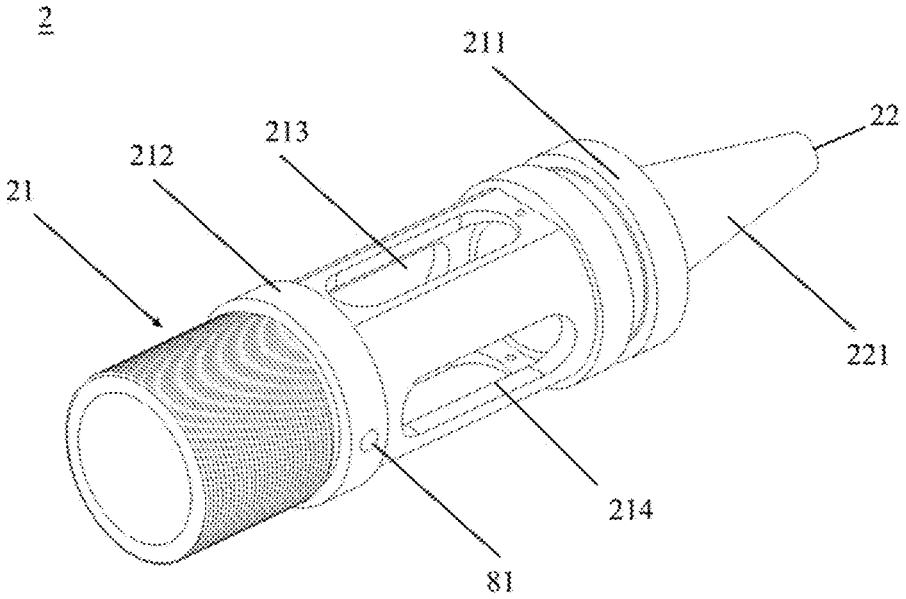
FIG. 11 is a perspective view of a nozzle according to the present disclosure.

In one embodiment of the present disclosure, as illustrated in FIGS. 4 and 11, an outer periphery of the hollow body 21 includes a first abutment portion 211 and a second abutment portion 212 both abutting against the inner wall of the housing 1. The first abutment portion 211 is located on a side of the second abutment portion 212 close to the discharge port 12. A portion of the hollow body 21 between the first abutment portion 211 and the second abutment portion 212 is a first chamber 213, the first chamber 213 is in communication with the first suction port 11, and an outer periphery of the first chamber 213 is circumferentially provided with hollow portions 214.

In the present disclosure, diameters of the first abutment portion 211 and the second abutment portion 212 are greater than a diameter of the first chamber 213, so that there is a flow-through space between the first chamber 213 and an inner wall of the housing 1, and a fluid entering from the first suction port 11 enters the first chamber 213 of the nozzle 2 through the flow-through space and the hollow portion 214. Four hollow portions 214 are evenly provided in a circumferential direction of the hollow body 21.

In one embodiment of the present disclosure, as illustrated in FIG. 4 again, in a direction close to the discharge port 12 along the axial direction, the nozzle outlet 22 is formed as a nozzle outer wall converging section 215 having a reduced diameter. The inner wall of the housing 1 is provided with a housing inner wall converging section 15 matched with the nozzle outer wall converging section 215. The housing 1 further includes a second suction port 16, and a second chamber 19 that is in communication with the second suction port 16 is formed between the first abutment portion 211 and the housing inner wall converging section 15. In the present disclosure, providing the first abutment portion 211 can prevent the fluid sucked in by the second suction port 16 from entering the first chamber 213 in advance to be mixed with the fluid in the first chamber 213, and the fluid at the outlet of the first chamber 213 enters the second chamber 19 and is mixed with the fluid sucked in by the second suction port 16 to transfer energy and momentum.

In one embodiment of the present disclosure, as illustrated in FIG. 3 again, a narrower diameter end of the housing inner wall converging section 15 is a refrigerant mixture inlet 151. The inner wall of the housing 1 further includes an equal-diameter section 17 and a diverging section 18, the equal-diameter section 17 and the diverging section 18, that are sequentially provided along a flow direction of a refrigerant mixture, allow the refrigerant mixture inlet 151 and the discharge port 12 to communicate with each other, and the nozzle 2 is movable in the axial direction to adjust an opening degree of the refrigerant mixture inlet 151. In the present disclosure, a first fluid sucked in by the first suction port 11 and a second fluid sucked in by the second suction port 16 are mixed in the second chamber 19 and then sequentially enter the equal-diameter section 17 and the diverging section 18 of the housing 1 through the refrigerant mixture inlet 151 and then are discharged. A refrigerant flow rate and pressure rise at the discharge port 12 can be adjusted by adjusting an opening degree of the refrigerant mixture inlet 151. Further, the hollow body 21 of the nozzle 2 has a converging section and a divergent section near the nozzle outlet 22, so that the high-pressure fluid expands and accelerates through the nozzle, a velocity is maximum at the nozzle outlet 22, a low-pressure region is formed between a nozzle outlet cross section and a refrigerant mixture inlet cross section, and a pressure difference is formed at the nozzle outlet 22. Under the action of the pressure difference, the low-pressure fluid is sucked into the second chamber 19 from the second inlet 16.

Figure 3:
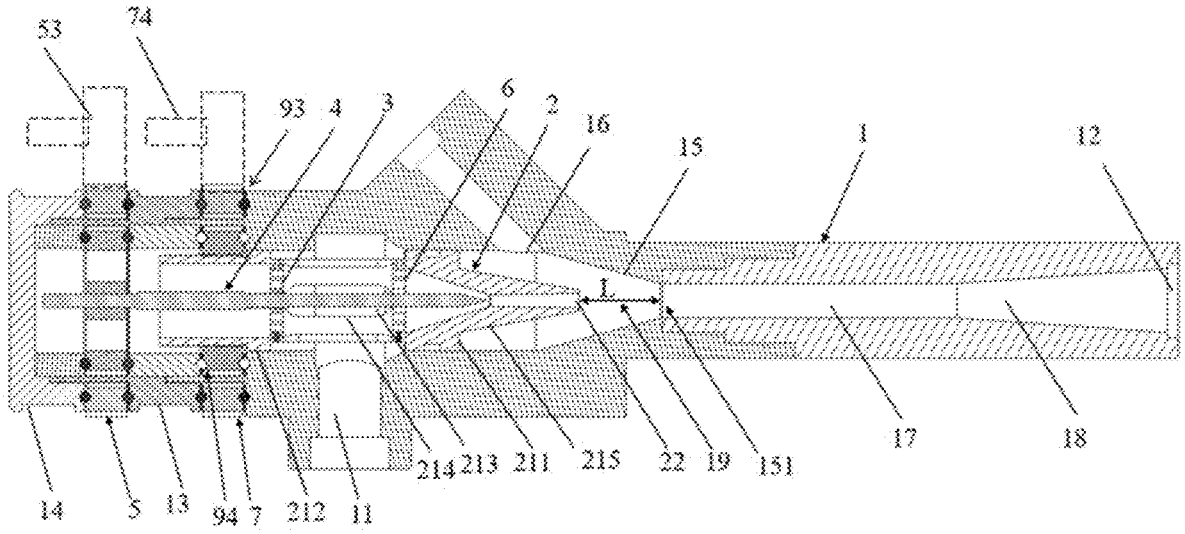
FIG. 3 is an axial cross-sectional view of the ejector according to the present disclosure in a second orientation.

Specifically, the ejector further includes a second magnetic rotation mechanism 7 that drives the nozzle 2 to move in the axial direction. As illustrated in FIG. 3, the second magnetic rotation mechanism 7 includes a second outer ring 71 and a second inner ring 72 coaxially disposed on an inner side of the second outer ring 71. An inner surface of the second outer ring 71 and an outer surface of the second inner ring 72 are spaced from and opposed to each other and correspondingly provided with a plurality of groups of magnets having opposite magnetic properties respectively, and the inner surface of the second inner ring 72 is in threaded connection with an outer surface of the nozzle 2. In the present disclosure, when the second outer ring 71 rotates, a magnetic field changes to drive the second inner ring 72 to rotate and the nozzle 2, which is in threaded connection with the second inner ring 72, to move in the axial direction, thereby adjusting a position of the nozzle 2. Therefore, the refrigerant flow rate and pressure rise at the discharge port 12 are adjusted. It is understandable to those skilled in the art that a technician can selectively adjust the refrigerant flow rate and pressure rise at the discharge port 12 by adjusting the position of the nozzle 2, or adjust the refrigerant flow rate at the nozzle outlet 22 by adjusting a position of the needle valve 4 in the nozzle 2, or simultaneously adjust the positions of the nozzle 2 and the needle valve 4 in the axial direction to change the refrigerant flow rate and pressure rise at the discharge port 12, as desired.

In one embodiment of the present disclosure, the second magnetic rotation mechanism 7 and the first magnetic rotation mechanism 5 are respectively located on two sides of the adapter 13. An end of the housing 1 opposite to the discharge port 12 is provided with a second cylindrical extension 73, the second outer ring 71 is sleeved outside the second cylindrical extension 73, and the second inner ring 72 is sleeved inside the second cylindrical extension 73, and the adapter 13 is in threaded connection with the second cylindrical extension 73, and the threaded connection is filled with a sealant.

In one embodiment of the present disclosure, as illustrated in FIG. 11, FIG. 12, FIG. 13, and FIG. 14, the ejector further includes a guide mechanism 8 that is provided between the housing 1 and the nozzle 2 and limit circumferential rotation of the nozzle 2 relative to the housing 1. Specifically, the guide mechanism 8 includes a recess 81, a sliding groove 82, and a ball 83. The recess 81 is provided on an outer sidewall of the nozzle 2, specifically, the recess 81 is provided on the second abutment portion 212. The sliding groove 82 is provided on the inner wall of the housing 1 and extends in the axial direction. One part of the ball 83 is accommodated in the recess 81, and the other part is accommodated in the sliding groove 82. For example, the recess 81 has a hemispherical concave surface that matches the ball 83, and the sliding groove 82 has a semicircular cross section. It is easy to understand that a length of the sliding groove 82 is generally designed to be slightly greater than a distance from the nozzle outlet 22 to the refrigerant mixture inlet 151.

When the second outer ring 71 of the second magnetic rotation mechanism 7 rotates driven by the external motor, the magnetic field between the second outer ring 71 and the second inner ring 72 changes, and the second inner ring 72 rotates together with the second outer ring 71 under a magnetic force of the magnet. Driven by the second inner ring 72, the nozzle 2 simultaneously generates relative motion, and can only move forward and backward along the axial direction of the hollow body 21 under the action of the guide mechanism 8. During this period, a distance L between the nozzle outlet 22 and the refrigerant mixture inlet 151 changes to cover working conditions under various pressures. Specifically, when the first suction port 11 operates under a high-pressure working condition, an L value should be large to ensure that the high-pressure fluid and the low-pressure fluid can be fully mixed. When the first suction port 11 operates under a low-pressure working condition, the L value should be small to ensure the subsequent pressure rise. Briefly, the distance L between the nozzle outlet 22 and the refrigerant mixture inlet 151 may be adjusted as the pressure changes. Therefore, operation efficiency of the ejector can be improved, power consumption of a compressor is further reduced, and therefore operation efficiency of the entire refrigeration system is improved.

Figure 15:
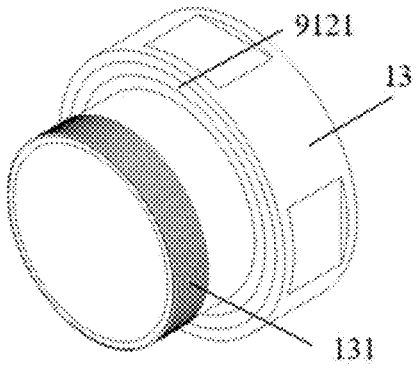
FIG. 15 is a perspective view of the adapter according to the present disclosure.
Figure 16:
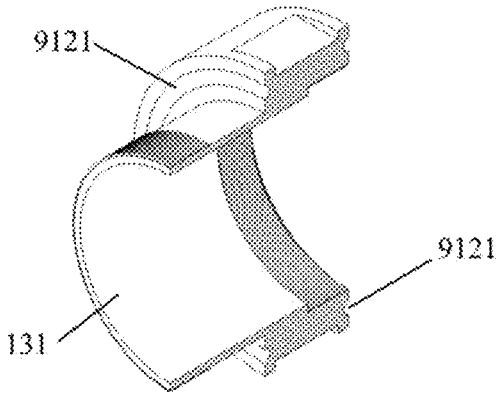
FIG. 16 is a cross-sectional view of the adapter in FIG. 15 according to the present disclosure.
Figure 17:
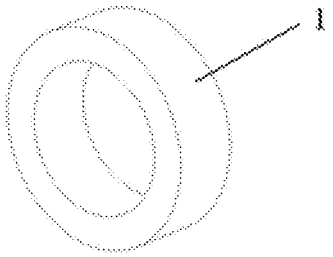
FIG. 17 is a perspective view of an A portion of the ejector illustrated in FIG. 4 according to the present disclosure.
Figure 18:
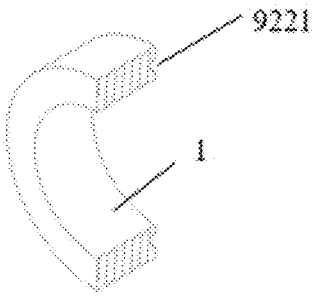
FIG. 18 is a cross-sectional view of FIG. 17 according to the present disclosure.
Figure 19:
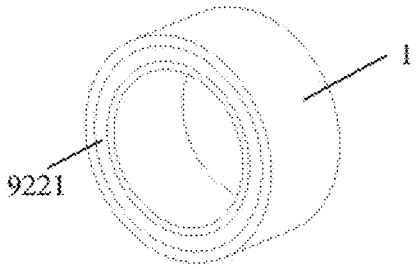
FIG. 19 is a perspective view of a B portion of the ejector illustrated in FIG. 4 according to the present disclosure.
Figure 20:
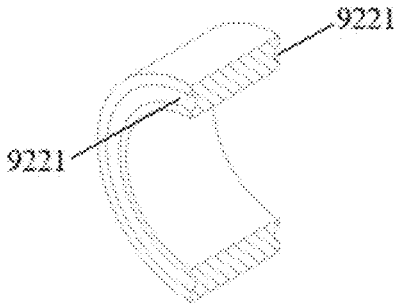
FIG. 20 is a cross-sectional view of FIG. 19 according to the present disclosure.

In one embodiment of the present disclosure, as illustrated in FIGS. 4, 6, 7, and 8, two sides of the first outer ring 51 are respectively provided with a first retaining ring 91, and the first retaining ring 91 includes a first annular body 911 and a plurality of first balls 912. The first annular body 911 is provided between the first outer ring 51 and the housing 1, and the plurality of first balls 912 are rotatably provided in the first annular body 911, so that the first outer ring 51 is prevented from moving in the axial direction, and meanwhile, the first outer ring 51 is constrained in a radial direction, and therefore the first outer ring 51 can only rotate around an axis thereof. Similarly, two sides of the first inner ring 52 are respectively provided with a second retaining ring 92, and the second retaining ring 92 includes a second annular body 921 and a plurality of second balls 922. The second annular body 921 is provided between the first inner ring 52 and the housing 1. The plurality of second balls 922 are rotatably provided in the second annular body 921, and a second ball ring groove 9221 for accommodating the second ball 922 is correspondingly formed between the first inner ring 52 and the housing 1. Providing the second retaining ring 92 can prevent the first inner ring 52 from moving in the axial direction, and meanwhile, constrain the first inner ring 52 in the radial direction, so that the first inner ring 52 can only rotate around an axis thereof. FIGS. 15 and 16 are schematic diagrams of distribution of first ball ring grooves 9121 on left and right sides of the adapter 13 (left and right sides based on the axial direction of the ejector). The first ball ring groove 9121 is used to provide a rotation space of the plurality of balls at corresponding positions. FIGS. 17 and 18 are schematic diagrams of distribution of the second ball ring grooves 9221 in the housing 1 on a left side of the first inner ring 52 (as at A portion in FIG. 4). FIG. 19 and FIG. 20 are schematic diagrams of distribution of the second ball ring groove 9221 in the housing 1 on a right side of the first inner ring 52 (as at B portion in FIG. 4).

Figure 2:
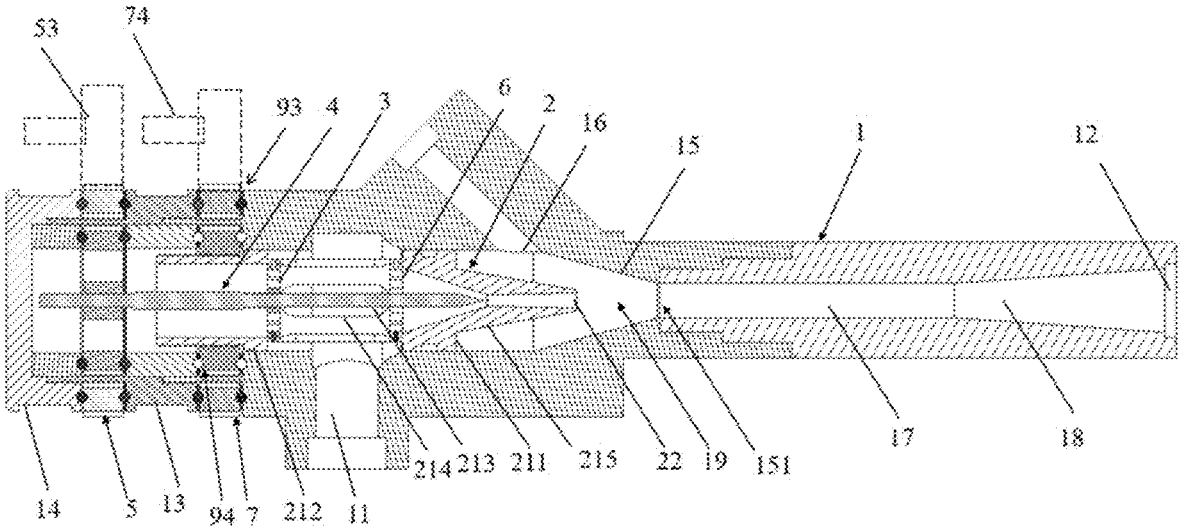
FIG. 2 is an axial cross-sectional view of the ejector according to the present disclosure in a first orientation.
Figure 12:
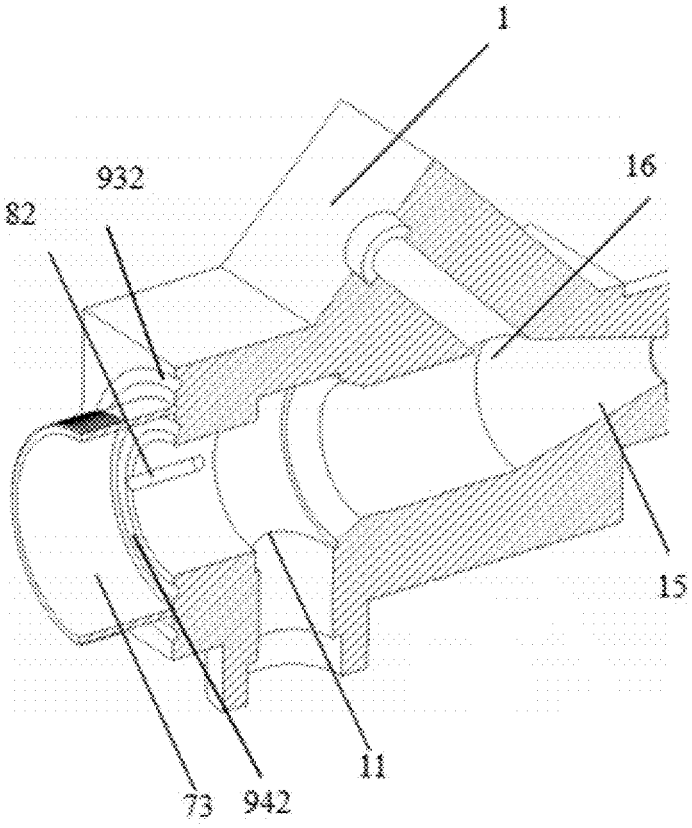
FIG. 12 is a schematic view of an internal structure of a housing according to the present disclosure.
Figure 13:
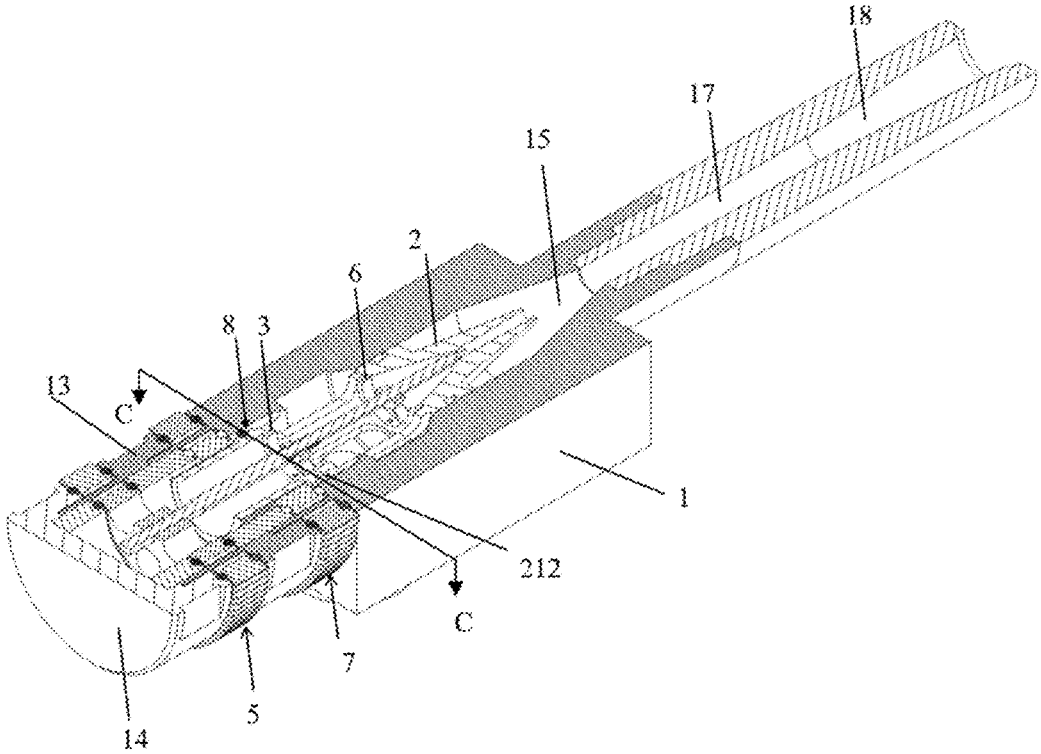
FIG. 13 is a schematic view of distribution of a guide structure of the ejector according to the present disclosure in the nozzle.
Figure 14:
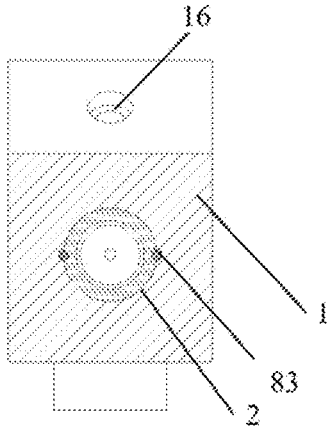
FIG. 14 is a cross-sectional view taken along line C-C in FIG. 13 according to the present disclosure.

Similarly, as illustrated in FIG. 2, in the second magnetic rotation mechanism 7, two sides of the second outer ring 71 are respectively provided with a third retaining ring 93, and two sides of the second inner ring 72 are respectively provided with a fourth retaining ring 94, so that the second outer ring 71 and the second inner ring 72 are prevented from moving in the axial direction, and meanwhile, the second outer ring 71 and the second inner ring 72 are constrained in the radial direction, and therefore the second outer ring 71 and the second inner ring 72 can only rotate around their axes. In the present disclosure, structures of the first retaining ring 91, the second retaining ring 92, the third retaining ring 93, and the fourth retaining ring 94 are the same, and all include an annular body and a plurality of balls (for example, a third ball 931 and a fourth ball 941) rotatably provided in the annular body. Further, FIGS. 4 and 12 illustrate schematic diagrams of distribution of a third ball ring groove 932 corresponding to the third ball 931 in the third retaining ring 93 on a right side of the second outer ring 71, and distribution of a fourth ball ring groove 942 corresponding to the fourth ball 941 in the fourth retaining ring 94 on a right side of the second inner ring 72, in the housing 1. Further, the third ball 931 in the third retaining ring 93 on a left side of the second outer ring 71 is correspondingly and rotatably provided in the first ball ring groove 9121 on the right side of the adapter 13, and the fourth ball 941 in the fourth retaining ring 94 on a left side of the second inner ring 72 is correspondingly and rotatably disposed in the second ball ring groove 9221 of the housing 1 (at B portion in FIG. 4).

In the present embodiment, cross sections of the first ball ring groove 9121, the second ball ring groove 9221, the third ball ring groove 932, and the fourth ball ring groove 942 are all semicircular. The first outer ring 51, the first inner ring 52, the second outer ring 71, and the second inner ring 72 are each formed with an annular groove that matches and engages with the ball ring groove at positions corresponding to rolling of the balls (such as the first outer ring 51 having first annular grooves 514 on both sides, and the first inner ring 52 having second annular grooves 524 on both sides). A cross section of the annular groove is semicircular, and the annular groove engages with the corresponding ball ring groove to form a rotating space having a circular cross section, allowing the balls to be rotatably provided.

In one embodiment of the present disclosure, an outer surface of the first outer ring 51 is provided with a first gear 513, and the first outer ring 51 is in transmission connection with a first external motor 53 through the first gear 513. Similarly, an outer surface of the second outer ring 71 is provided with a second gear 711, and the second outer ring 71 is in transmission connection with a second external motor 74 through the second gear 711.

As described above, the ejector according to the present disclosure has a simple structure, low cost, and high reliability, and the refrigerant flow rate at the nozzle outlet 22 is changed by adjusting the position of the nozzle and/or the needle valve, thereby adapting to different working conditions and ensuring the stability of the system.

In addition, the present disclosure further provides a refrigeration system provided with the above ejector. The refrigeration system includes a compressor, a condenser, an evaporator, a throttling device, a gas-liquid separator, and the like connected by pipelines. The first suction port 11 of the ejector is in communication with the condenser, the second suction port 16 of the ejector is in communication with the evaporator, and the discharge port 12 of the ejector is in communication with the gas-liquid separator. As indicated above, the above ejector can meet the requirements of the compressor under various pressure conditions, and further reduce the power consumption of the compressor, thereby improving the operation efficiency of the entire refrigeration system. Therefore, the ejector according to the present disclosure is suitable for popularization and disclosure to various refrigeration systems.

The above embodiments are merely preferred embodiments of the present disclosure and are not intended to limit the present disclosure. Any modifications, equivalent substitutions, and improvements made within the spirit and principles of the present disclosure shall be included in the protection scope of the present disclosure.

The invention claimed is:

1. An ejector comprising: a housing including a first suction port and a discharge port, the discharge port being located at one end of the housing in an axial direction; a nozzle that is provided in the housing and includes a hollow body and a nozzle outlet, an interior of the hollow body being in communication with the first suction port, and the nozzle outlet being in communication with the discharge port; a first retainer fixed in the nozzle, a center of which being formed with a first retainer through hole; a needle valve including a first end, a second end, and a threaded section between the first end and the second end, the threaded section being engaged with the first retainer through hole, and the first end being movable between a position away from the nozzle outlet and a position abutting against the nozzle outlet to adjust an opening degree of the nozzle outlet; and a first magnetic rotation mechanism including a first outer ring and a first inner ring coaxially disposed on an inner side of the first outer ring, an inner surface of the first outer ring and an outer surface of the first inner ring being spaced from and opposed to each other and correspondingly provided with a plurality of groups of magnets having opposite magnetic properties respectively, a center of the first inner ring being provided with an inner ring through hole, and the second end of the needle valve being matched with and passing through the inner ring through hole in a manner that allows sliding in the axial direction and torque transmission.

2. The ejector according to claim 1, further comprising:

an adapter detachably connected to an end of the housing opposite to the discharge port, the adapter including a first cylindrical extension, the first outer ring being sleeved outside the first cylindrical extension, and the first inner ring being sleeved inside the first cylindrical extension; and an end cap detachably fixed to the first cylindrical extension.

3. The ejector according to claim 2, wherein a connection between the first cylindrical extension and the end cap is filled with a sealant.

4. The ejector according to claim 2, wherein an outer periphery of the hollow body includes a first abutment portion and a second abutment portion both abutting against an inner wall of the housing, the first abutment portion is located on a side of the second abutment portion close to the discharge port, a portion of the hollow body between the first abutment portion and the second abutment portion is a first chamber, the first chamber is in communication with the first suction port, and an outer periphery of the first chamber is provided with a hollow portion.

5. The ejector according to claim 4, wherein in a direction close to the discharge port along the axial direction, the nozzle outlet is formed as a nozzle outer wall converging section having a reduced diameter, and the inner wall of the housing is provided with a housing inner wall converging section matched with the nozzle outer wall converging section, and the housing further includes a second suction port, and a second chamber that is in communication with the second suction port is formed between the first abutment portion and the housing inner wall converging section.

6. The ejector according to claim 5, wherein a narrower-diameter end of the housing inner wall converging section is a refrigerant mixture inlet, and the inner wall of the housing further includes an equal-diameter section and a diverging section, and the equal-diameter section and the diverging section, which are sequentially provided along a flow direction of a refrigerant mixture, allow the refrigerant mixture inlet and the discharge port to communicate with each other, and the nozzle is movable in the axial direction to adjust an opening degree of the refrigerant mixture inlet.

7. The ejector according to claim 6, further comprising:

a second magnetic rotation mechanism including a second outer ring and a second inner ring coaxially disposed on an inner side of the second outer ring, wherein an inner surface of the second outer ring and an outer surface of the second inner ring are spaced from and opposed to each other and correspondingly provided with a plurality of groups of magnets having opposite magnetic properties respectively, and the inner surface of the second inner ring is in threaded connection with an outer surface of the nozzle.

8. The ejector according to claim 7, wherein an end of the housing opposite to the discharge port is provided with a second cylindrical extension, the second outer ring is sleeved outside the second cylindrical extension, and the second inner ring is sleeved inside the second cylindrical extension, and the adapter is in threaded connection with the second cylindrical extension, and the threaded connection is filled with a sealant.

9. The ejector according to claim 6, further comprising:

a guide mechanism provided between the housing and the nozzle and configured to limit circumferential rotation of the nozzle relative to the housing.

10. The ejector according to claim 9, wherein the guide mechanism includes a recess provided on an outer sidewall of the nozzle, a sliding groove provided on the inner wall of the housing and extending in the axial direction, and a ball, one part of which being accommodated in the recess, and the other part of which being accommodated in the sliding groove.

11. The ejector according to claim 1, wherein a cross section of the second end of the needle valve is non-circular.

12. The ejector according to claim 1, wherein a transition section is provided between the second end of the needle valve and the threaded section, and a cross-sectional dimension of the transition section is larger than that of the threaded section and the second end.

13. The ejector according to claim 1, further comprising:

a second retainer fixed in the nozzle and located on a side of the first retainer close to the nozzle outlet, wherein a center of the second retainer is provided with a second retainer through hole through which the needle valve passes.

14. The ejector according to claim 1, wherein the inner surface of the first outer ring is provided with a first magnet and a second magnet, the first magnet and the second magnet are sequentially and alternately connected, magnetism of the first magnet is opposite to magnetism of the second magnet, and the number of the first magnet and the number of the second magnet are the same and are respectively at least two, and the outer surface of the first inner ring is provided with a third magnet and a fourth magnet, the third magnet and the fourth magnet are sequentially and alternately connected, magnetism of the third magnet is opposite to magnetism of the fourth magnet, and the number of the third magnet and the number of the fourth magnet are the same and are respectively at least two.

15. The ejector according to claim 14, wherein the first magnet and the second magnet are fixed on the inner surface of the first outer ring by bonding, riveting, or threaded connection, and the third magnet and the fourth magnet are fixed on the outer surface of the first inner ring by bonding, riveting, or threaded connection.

16. The ejector according to claim 15, wherein the first magnet and the second magnet are the same in size and shape, and the third magnet and the fourth magnet are the same in size and shape.

17. The ejector according to claim 1, wherein two sides of the first outer ring are respectively provided with a first retaining ring, and the first retaining ring includes a first annular body provided between the first outer ring and the housing, and a plurality of first balls rotatably provided in the first annular body, and two sides of the first inner ring are respectively provided with a second retaining ring, and the second retaining ring includes a second annular body provided between the first inner ring and the housing, and a plurality of second balls rotatably provided in the second annular body.

18. The ejector according to claim 1, wherein an outer surface of the first outer ring is provided with a gear, and the first outer ring is in transmission connection with an external motor through the gear.

19. A refrigeration system, wherein the refrigeration system is provided with the ejector according to claim 1.

* * * * *